United States Patent [19]

Dewinck et al.

[11] Patent Number: 4,598,464

[45] Date of Patent: Jul. 8, 1986

[54] PROCESS FOR THE MANUFACTURE OF COLLECTORS OF DIRECT CURRENT ELECTRIC MACHINES

[75] Inventors: Jean Dewinck, Ransart; Lucien Hancart, Mont-sur-Marchienne, both of Belgium

[73] Assignee: Ateliers de Constructions Electriques de Charleroi, Brussels, Belgium

[21] Appl. No.: 573,393

[22] Filed: Jan. 24, 1984

[30] Foreign Application Priority Data

Jan. 24, 1983 [EP] European Pat. Off. ..... 83200097

[51] Int. Cl.[4] ..... C21D 1/04; C21D 1/10; H01R 43/00

[52] U.S. Cl. ..... 29/597; 148/108; 310/179

[58] Field of Search ..... 29/597, 733; 219/10.41, 219/10.43, 10.57, 10.75, 10.77; 310/233, 234, 235, 236, 179; 148/108, 142, 154

[56] References Cited

U.S. PATENT DOCUMENTS

| | | | |
|---|---|---|---|
| 593,282 | 11/1897 | Short | 29/733 |
| 855,134 | 5/1907 | Risbridger | 29/733 |
| 3,932,205 | 1/1976 | Lindholm et al. | 29/592 X |
| 4,032,740 | 6/1977 | Mittelmann | 219/10.77 |

FOREIGN PATENT DOCUMENTS

| | | | |
|---|---|---|---|
| 109523 | 8/1980 | Japan | 219/10.77 |

*Primary Examiner*—Howard N. Goldberg
*Assistant Examiner*—Timothy V. Eley
*Attorney, Agent, or Firm*—Schwartz, Jeffery, Schwaab, Mack, Blumenthal & Evans

[57] ABSTRACT

Disclosed is a process for the production of a collector in the form of a collector ring for use with direct current electric machines. The process consists of heating the collector ring, comprising copper sheets and insulating mica plates, assembled in a conventional apparatus by means of an inductor coaxial with the ring, and of exposing the collector ring to a radial pressure by applying to the apparatus a pressure of a predetermined value by means of a press.

6 Claims, 2 Drawing Figures

PROCESS FOR THE MANUFACTURE OF COLLECTORS OF DIRECT CURRENT ELECTRIC MACHINES

BACKGROUND OF THE INVENTION

The present invention relates to a process for the production of a collector for use with direct current electric machines.

The collector of an electric machine is an apparatus that is highly stressed in service. Its production requires attentive care since the collector, which consists of copper sheets and micaceous insulation arranged in rings, must behave as a solid entity, in spite of the centrifugal forces, vibrations and heating imposed by the operation.

To obtain satisfactory performance of the collector in service, the conventional process consists of exposing the collector to artificial aging by a succession of radial stresses, effected alternatively at the ambient temperature and at a temperature of the order of 200° C., by means of an appropriate apparatus.

In view of the large weight of the band, the segments, the plates and the spider which constitute the tooling and the weight of the collector itself, each heating or cooling operation requires several hours. The complete cycle of the aging of the collector is of the order of a week for large sizes. The conventional process ties up for several days the tools, the furnaces and the cooling areas and involves the consumption of large amounts of energy.

SUMMARY OF THE INVENTION

The manufacture of collectors according to the process claimed eliminates these difficulties by being effected in a single heating cycle under stress with the aid of an induction heating installation mounted on a press.

The process claimed is described in detail with reference to the following figures.

DETAILED DESCRIPTION OF PREFERRED EMBODIMENTS

Figure 1:
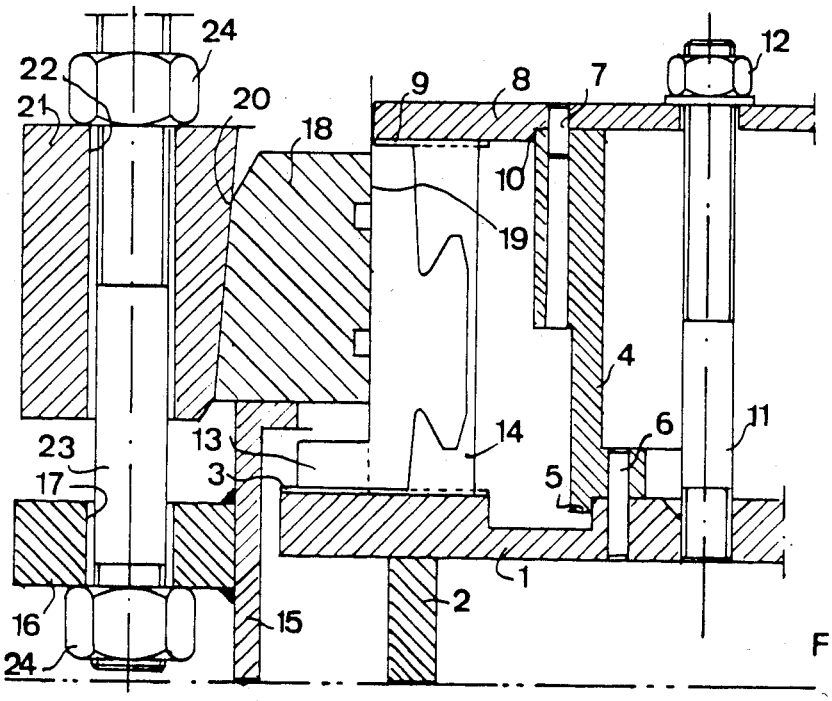
FIG. 1 is a cross sectional view taken through a collector ring and the mounting and loading equipment.

FIG. 1 shows a support plate 1 supported by a stand 2 and equipped on its top surface with a plurality of radial grooves 3 to position the component elements of the collector to be manufactured. A spider 4, centered on the plate 1 by means of a shoulder 5 carries a plurality of studs 6, serving to position the spider 4 on the plate 1 and studs 7 serving to position an upper plate 8 also equipped on its bottom surface with radial grooves 9 located opposite the radial grooves 3 of the bearing plate 1.

The upper plate 8 is centered on the spider 4 by means of a shoulder 10 and is joined with the bearing plate with the aid of a threaded center bolt 11 and a nut 12. The sheets of the collector 13 and the micaceous insulating plates 14, are slid alternatively between the support plate 1 and the upper plate 8 by using the radial grooves 3 and 9 which serve as guides for the micaceous insulating plates 14 which are intended to insulate the sheets of the collector 13. Around the support plate 1 is arranged a support 15 equipped with a clampling ring 16 which is pierced on its periphery by a number of bolt holes 17. The support 15 receives several segments 18 uniformly spaced around its entire periphery and arranged so as to provide between them oblique intervals in such manner as to act on all of the sheets 13 of the collector. The inner surface of each segment 18 is designed to conform to a cylinder 19 having a diameter adapted to that of the collector to be manufactured and of which the external surface of all segments 18 together resemble a truncated cone complementing the conicity of a band 21. The band 21 comprises a plurality of bolt holes 22 coinciding with the bolt holes 17 of the ring 16 of the clamping support 15 for the insertion of the threaded bolts 23, the nuts 24 which serve to tighten the band 21 of the clamping ring 16. This tightening, which is in fact a drawing down of the band 21 corresponding to a radial displacement of the segments 18 results in a reduction of the diameter of the collector ring made up of the sheets 13.

At the onset of the operation of assembling the collector, only the mounting apparatus, made up of the support plate 1, the spider 4 and the upper plate 8, is used. The assembly operation consists of sliding the sheets 13 and the insulating mica plates 14 into the radial grooves 3 and 9 of the support plate 1 and the upper plate 8, respectively. When the assembly is complete, the support 15 is set in place to receive the segments 18 distributed uniformly over the periphery of the collector ring. The band 21 is then rotatably positioned about the segments 18 and partially contracted by means of the threaded rods 23 and their nuts 24 and 25.

Figure 2:
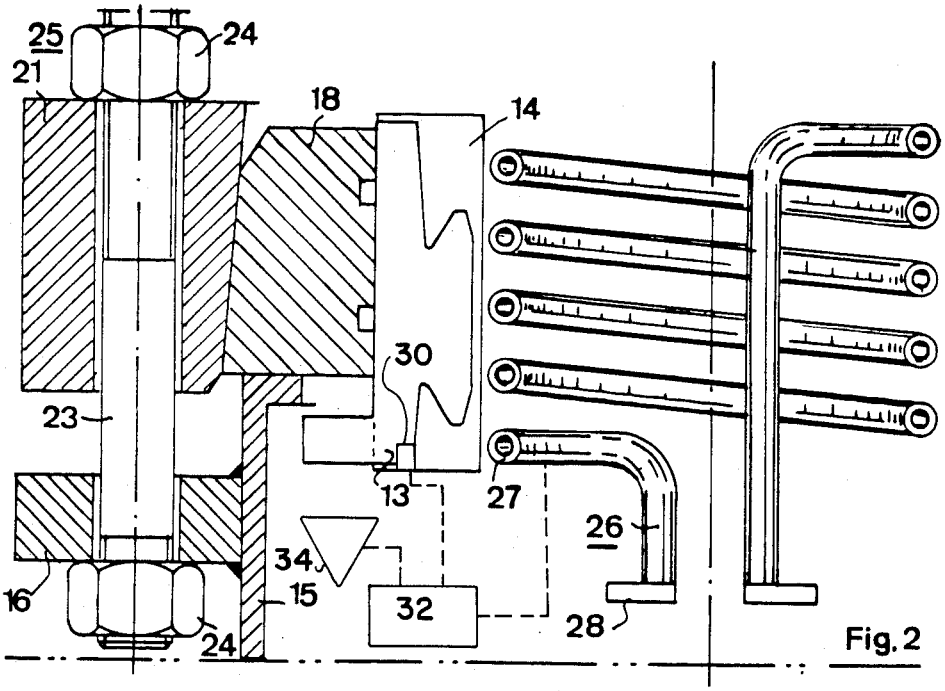
FIG. 2 is a cross sectional view taken through a collector ring, the loading apparatus and the induction heating device.

When the pressure obtained by the bolting has resulted in a first reduction of the diameter of the collector ring, the latter no longer requires the support of the plates 1 and 8. The mounting apparatus comprising the bearing plate 1, the spider 4 and the upper plate 8 is therefore removed to release the center part. The further sequence of operations may be followed in FIG. 2, which shows the collector ring formed of the collector sheets 13 and the insulating mica plates 14, stress tooling 25 made up of the segments 18, the band 21, the support 15 joined to the ring 16, threaded bolts 23 and their nuts 24. An inductor 26 is placed in the central part of the collector ring. In the example of embodiment shown in FIG. 2, the inductor is in the form of a solenoid, the hollow turns 27 there of being spread over the entire length of the collector ring. A cooling fluid is circulating through the turns 27, which end in fastening tabs 28. Optionally, a device to measure the temperature of the sheets 13 may modulate the heating power during the entire operation.

While a press, not shown, applies a continuously controlled pressure to the band 21, the inductor 26 is fed a high frequency current.

By the choice of a supply frequency of the order of several hundred KHz, depending on the dimensions of the collector to be manufactured, the inductor 26 induces in the sheets 13 certain surface Foucault currents which heat the sheets, together with the insulating mica plates 14, which are in intimate contact with the sheets. By constantly maintaining the band 21 under stress, a radial pressure is applied by means of the segments 18 to the sheets 13 and the mica insulation 14, thereby contributing to the reduction in diameter of the collector ring. This reduction in diameter corresponds to an actual shrinkage of the collector. At the onset of the heating operation under pressure, the shrinkage is substantial and is then reduced gradually as a function of time leading in an asymptotic manner toward zero shrinkage. The evolution of the shrinkage of the collector is controlled either by reference to a graph, for example at constant pressure, which plots the tightening of the band as a function of time for each collector, or in a more convenient fashion, by developing for each collector size a duration of the stressing period corresponding to the period of the time recorded to obtain zero shrinkage.

It is obvious that several variants may be used for the inductor, for example an inductor wherein one or several of the terminal turns have larger diameters in order to more closely follow the contour of the sheets 13, or an inductor made up of two half-coils, one of which being introduced from the top of the collector ring and the other of which being introducted from the bottom of the collector ring with both of the half-coils having a profile closely adapted to the sheet 13.

Similarly, one can envisage a spatial distribution of the turns of the inductor in accordance with a variable pitch as a function of the volume to be heated.

Regarding the probes to determine the temperature attained by the sheets, any known solution may be used to modulate the heating power of the inductor 26. For example, a temperature probe 30 can be placed on one or several of the sheets 13 and connected with a device 32 which modulates the heating power of the inductor 26. Alternatively, an infrared sensor 34 can be placed in the vicinity of the sheets 13 and connected with the power modulating device 32.

We claim:

1. A process for the manufacture and artificial aging of a collector in the form of a collector ring, comprising the steps of:

positioning a collector ring comprising at least one collector sheet and at least one micaceous insulating plate in a stressing apparatus; and heating said ring by means of an inductor coaxial with said ring, wherein said stressing apparatus radially stresses said collector ring at predetermined values during heating.

2. A process according to claim 1, wherein said inductor comprises at least one solenoid extending along at least a section of said collector sheets and having an external diameter smaller than the inner diameter of the ring.

3. A process according to claim 2, wherein said solenoid extends along the entire height of said collector sheets.

4. A process according to claim 1, comprising the further step of monitoring the temperature of said collector ring during processing and utilizing said monitored temperature to modulate the heating power of said inductor.

5. A process according to claim 4, wherein said temperature monitoring step comprises monitoring the temperature by means of at least one temperature probe on at least one of said collector sheets and connecting said probe to a device for modulating the heating power of said inductor.

6. A process according to claim 4, wherein said temperature monitoring step comprises monitoring the temperature by means of an infrared sensor positioned in the vicinity of said collector sheets and connecting said sensor to a device for modulating the heating power of said inductor.

* * * * *